US006671492B2

(12) United States Patent
Mimura et al.

(10) Patent No.: US 6,671,492 B2
(45) Date of Patent: Dec. 30, 2003

(54) IMAGE FORMING DEVICE WITH SHEET FINISHER

(75) Inventors: Hideki Mimura, Yamanashi-ken (JP); Keiichi Nagasawa, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 09/927,414

(22) Filed: Aug. 13, 2001

(65) Prior Publication Data

US 2002/0021924 A1 Feb. 21, 2002

(30) Foreign Application Priority Data

Aug. 14, 2000 (JP) ..... 2000-245625

(51) Int. Cl.[7] ..... G03G 15/00
(52) U.S. Cl. ..... 399/407
(58) Field of Search ..... 399/407, 403, 399/404, 405

(56) References Cited

U.S. PATENT DOCUMENTS 5,473,420 A * 12/1995 Rizzolo et al. ..... 399/107

FOREIGN PATENT DOCUMENTS

| | | |
|---|---|---|
| JP | 8-340414 | * 12/1996 |
| JP | 2001-72311 | 3/2001 |
| JP | 2001-316025 | * 11/2001 |

* cited by examiner

*Primary Examiner*—Quana M. Grainger
(74) *Attorney, Agent, or Firm*—Kanesaka & Takeuchi

(57) ABSTRACT

An image forming device includes an image forming device main body having a discharge portion with a discharge opening for discharging a sheet from one side thereof, a loading tray provided at a top surface of the device main body and lower than the discharge opening for receiving the sheet discharged from the discharge opening, and a sheet finisher unit disposed above the loading tray. The sheet finisher unit includes a supporting device for supporting a conveying direction downstream side of the sheet discharged from the discharge opening, a finishing processing device disposed at one side of the supporting device for carrying out a finishing processing on the sheet supported on the supporting device, and a transfer device for transferring the sheet, which has been processed at the finishing processing means, to the loading tray. The supporting device constitutes the transfer device.

13 Claims, 11 Drawing Sheets

IMAGE FORMING DEVICE WITH SHEET FINISHER

BACKGROUND OF THE INVENTION AND RELATED ART STATEMENT

The present invention relates to an image forming device, such as a copier, a printer, a facsimile device, or the like, which is equipped with a sheet finisher which staples or punches holes in sheets. In particular, the present invention relates to an image forming device equipped with a sheet finisher which is extremely compact and which can be mounted to an image forming device which has a loading tray at a top surface of the device and has a sheet discharging portion projecting above the loading tray.

Japanese Patent Application Laid-Open (KOKAI) No. 1-313261 illustrated in FIG. 10 is known as a conventional image forming device. In this image forming device, a sheet finisher 100 is set at the outer side of an image forming device main body 101, and a loading tray 102 is set at the outer side of the sheet finisher 100.

In FIG. 10, a sheet S (not shown), which is copied at the image forming device main body 101 and is fed-out by sheet discharging rollers 105, is conveyed to the sheet finisher 100 mounted to the outer side of the image forming device main body 101. The sheets S, which have been conveyed to the sheet finisher 100, are stapled by a staple unit 103 provided at the sheet finisher 100.

The sheets S, for which stapling has been completed, are pushed by an abutting member 104 and are loaded onto the loading tray 102. The abutting member 104 supports the conveying direction trailing ends of the sheets S, aligns these trailing ends, and, when stapling is completed, pushes the trailing ends of the sheets S out toward the loading tray 102.

The sheet finisher 100 is mounted to the outer side of a side surface of the image forming device main body 101 shown in FIG. 10. The loading tray 102 is mounted to the outer side of the sheet finisher 100. Thus, when the sheet finisher 100 is set at the image forming device main body 101, the area required for the placement of the image forming device main body 101 increases.

An image forming device 106 of Japanese Patent Laid-Open No. 2000-86076 which is shown in FIG. 11 has one way of overcoming this drawback. A sheet finisher 107 is mounted between the image forming device 106 and an image reader 108. The area required to place the image forming device 106 which is formed in this way can be reduced by an amount corresponding to the amount by which the sheet finisher 107 is mounted toward the inner side of the image forming device main body 106.

However, loading trays 109, on which the sheets S which have been subjected to finishing processing are loaded, still project outwardly from the side surface of the image forming device 106. Usually, the loading trays 109 are extremely large compared to the sheet finisher 107. Thus, if the loading trays 109 remain jutting out, the area for placing the image forming device 106 can hardly be reduced at all.

A structure, such as that disclosed in Japanese Patent Laid-Open No. 8-277059 and shown in FIG. 12, is known in which a sheet finisher 110 is mounted above a loading tray 111. This sheet finisher 110 has an internal tray 112. The internal tray 112 is formed from two trays which are a first tray 112*a* and a second tray 112*b*. The internal tray 112 opens like a door toward the loading tray 111 from the portion at which these two trays are connected.

The sheets S are stapled on the internal tray 112, and when stapling is completed, the internal tray 112 is opened. When the internal tray 112 is opened, the stack of sheets S falls down of its own weight onto the loading tray 111, so as to be set on the loading tray 111.

Accordingly, the area for placement of the sheet finisher 110 can be reduced because the internal tray 112, which supports the entire surfaces of the sheets being stapled, and the loading tray, onto which the stapled sheets are loaded, are disposed in parallel in the vertical direction.

However, because the internal tray 112 opens and closes in a door-like manner, a sufficient height is required at the sheet finisher 110 for the internal tray 112 to open, and mounting the sheet finisher 110 into the image forming device is extremely difficult. Even if the sheet finisher 110 is mounted in, when the sheet finisher 110 having a height for allowing the internal tray to open is mounted in the image forming device, the height of the image forming device increases.

If the height of the image forming device increases, when an original, whose image is to be formed, is set at the image forming device, the position at which the original is set is high. If the position at which the original is set is high, it is difficult to confirm the set position. Accordingly, there is the problem that this tall image forming device is difficult to use.

Further, in order to mount the sheet finisher 110, which is tall, in the interior of the image forming device, a large space is required at the interior of the image forming device. However, because attempts are being made to make the existing image forming devices as compact as possible, usually, such a large space is not provided in the existing image forming device. Accordingly, there is the problem that the sheet finisher 110 can not be mounted into the existing image forming devices.

A first object of the present invention is to provide an image forming device with an easy-to-use sheet finisher, wherein the sheet finisher can be easily mounted into existing image forming devices and does not cause the area for placement of the image forming device to become large.

A second object of the present invention is to provide an image forming device which is equipped with the sheet finisher, wherein a loading tray at a top surface of the image forming device can be utilized as a loading portion of the sheet finisher and as a stacking portion for finished sheets, and when the sheet finisher is mounted, there is no need to provide another stacking tray for the finished sheets.

A third object of the present invention is to provide an image forming device with an easy-to-use sheet finisher, wherein even if the sheet finisher is mounted to the existing image forming device, sheets can be removed without greatly changing from the state before the sheet finisher was mounted.

Further objects and advantages of the invention will be apparent from the following description of the invention.

SUMMARY OF THE INVENTION

In order to achieve the above objects, an image forming device of the present invention includes a discharge portion having a discharge opening which discharges a sheet from one end side of a top surface of an image forming device main body, in a direction traversing the device main body, and a loading tray which is provided at the top surface of the device main body and lower than the discharge opening, and on which a sheet which is discharged from the discharge opening is loaded. A sheet finisher unit is disposed above the loading tray, and in the sheet finisher unit, supporting means for supporting a conveying direction downstream side of a sheet which is discharged; finishing processing means, disposed at one end side of the supporting means, for carrying out a finishing processing on the sheet which is supported on the supporting means; and a transfer means which transfers and discharges the sheet, which has been processed at the finishing processing means, to the loading tray which is located at a conveying direction downstream side, are formed as a unit.

Accordingly, the loading tray at the top surface of the image forming device can be used as the loading portion of the sheet finisher and as the stacking portion of the sheets which have been subjected to finishing processing. When the sheet finisher is mounted, there is no need to provide a new stacking tray for the sheets which have been subjected to finishing processing.

Further, an image forming device in accordance with the present invention includes a discharge portion having a discharge opening which discharges a sheet from one end side of a top surface of an image forming device main body, in a direction traversing the device main body. Supporting means for supporting a conveying direction downstream side of a sheet discharged from the discharge opening; finishing processing means, disposed adjacent to one end side of the supporting means, for carrying out finishing processing on the sheet which is supported on the supporting means; transfer means for transferring the sheet, which is processed at the finishing processing means, to a conveying direction downstream side; and a loading tray on which the sheet, which is transferred by the transfer means, is loaded, are formed as a unit. This sheet finishing processing unit is disposed at a position corresponding to the discharge opening of the top surface of the main body.

Accordingly, the supporting means, the finishing processing means such as a stapler or the like, the sheet transfer means, and the loading tray on which sheets transferred by the transfer means are stacked, are formed as a unit. The unit is loaded at the discharge opening, from which the sheets are discharged, in a direction traversing the device main body. Thus, the sheet finisher can easily be mounted even to the existing image forming devices having a loading tray unsuitable for the loading of sheets which have been subjected to finishing processing. Further, the image forming device of the present invention can be used as the image forming device to which the sheet finisher is mounted, without enlarging the area for placement of the image forming device.

Moreover, an image forming device of the present invention includes a loading tray which is provided at a top surface of an image forming device main body and on which a discharged sheet is loaded, and an image reader which is provided above the loading tray and which reads an image of an original, and at the image forming device, a sheet discharged onto the loading tray is removed from a front side intersecting a sheet discharging direction. The image forming device comprises a sheet finisher between the loading tray and the image reader, and the sheet finisher includes: supporting means for supporting a conveying direction downstream side of a discharged sheet; finishing processing means, disposed at one end side of the supporting means, for carrying out finishing processing on the sheet supported on the supporting means; transfer means for transferring the sheet, which is processed at the finishing processing means, to a conveying direction downstream side; and driving means for driving the transfer means, wherein at least the finishing processing means and the driving means are disposed at an opposite side of a sheet removing direction.

Accordingly, the finishing processing unit and the driving means of the finisher are disposed at the opposite side from the sheet removal direction. Thus, the image forming device equipped with the easy-to-use sheet finisher is provided, wherein even when the sheet finisher is mounted to the existing image forming device, sheets can be removed without greatly changing the way of removing sheets from a case in which the sheet finisher is not mounted.

BRIEF DESCRIPTION OF THE DRAWINGS

FIG. 6(*b*) is an explanatory view showing a state when the sheets of the first embodiment are being released;

FIG. 6(*c*) is an explanatory view showing a state after the sheets of the first embodiment have been released;

FIG. 7(*b*) is an explanatory view showing a state when the sheets are being aligned by the adjusting plate;

FIG. 7(*c*) is an explanatory view showing a state in which the sheets have been aligned by the adjusting plate;

DETAILED DESCRIPTION OF PREFERRED EMBODIMENTS

Figure 1:
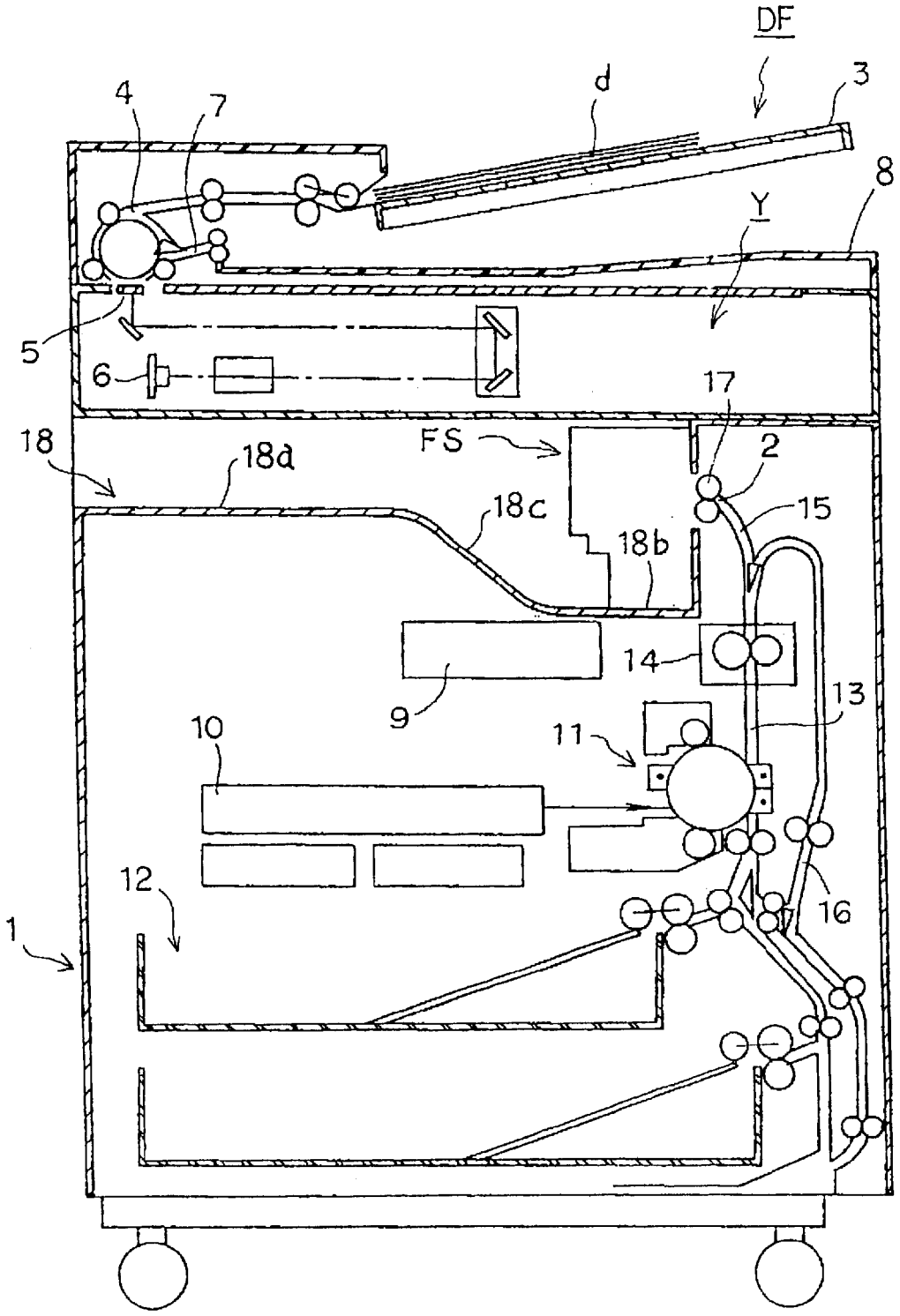
FIG. 1 is an overall schematic view of a first embodiment.

FIGS. 1 through 7 illustrate a first embodiment of the present invention. FIG. 1 is an overall structural view of an image forming device 1 which is equipped with a sheet finisher FS, an automatic document feeder DF, and an image reader Y.

The image reader Y and the automatic document feeder DF are disposed above the image forming device 1. A discharge opening 2, which discharges sheets S on which images are formed, is provided in the space between the image forming device 1 and the image reader Y. The sheet finisher FS is connected to the discharge opening 2.

Mounting portion la for mounting the sheet finisher FS is formed at the image forming device 1. The sheet finisher FS is mounted by projections 27*d*, which are formed at a cover 27 of the sheet finisher FS which will be described later, inserted into the mounting portions 1*a*.

When documents d are disposed on a document stand 3 of the automatic document feeder DF, the documents d are conveyed to a document supply path 4 by conveying rollers, and reach a reading section 5. The image on a document d which has reached the reading section 5 is read by an image reading element 6 of the image reader Y.

The document d, which has passed through the reading section 5 and whose image has been read, is conveyed onto a document return tray 8 from a document discharge path 7.

Here, when there are images on both sides of the document d, the document d, which has been conveyed once to the document return tray 8, is conveyed reversely to the document supply path 4 again. Then, the document d is inverted, and at this time, the image on the surface opposite to the surface which was read previously is read by the sensor 6.

The image which is read by the sensor 6 is transmitted to an image processing section 9 as an analog signal. The image processing section 9 which has received the image signal carries out analog processing, A/D conversion, shading correction, image compression processing, and the like, and thereafter, sends the processed image signal to an image writing section 10.

The image writing section 10 which has received the processed image signal illuminates the image signal as the output light from a semiconductor laser on a photosensitive drum of an image forming section 11, such that the image is developed on the drum.

At the image forming section 11, the image is transferred onto the sheet S. The sheets S are supplied one-by-one from a cassette sheet-supplying section 12 by rollers to a sheet feed path 13. The image forming section 11 is disposed on the sheet feed path 13. The image forming section 11 transfers the image of the document d, which has been developed on the photosensitive drum, onto the sheet S which is passing through the sheet feed path 13.

The sheet S, onto which an image has been transferred in this way, is sent further downstream in the sheet feed path 13. A fixing section 14 is provided on the sheet feed path 13 at the downstream side of the image forming section 11. The image, which has been transferred at the image forming section 11, is fixed onto the sheet S at the fixing section 14.

When the image is fixed at the fixing section 14, the sheet S is conveyed even further downstream, and is discharged from the discharge opening 2 via a discharge path 15. Rollers 17 are provided at the discharge opening 2, and the sheet S is discharged by the rollers 17.

When the images are to be formed on both surfaces of the sheet S, the sheet S is not sent from the fixing section 14 to the discharge path 15, and rather, is sent from the fixing section 14 to a both-sides path 16. At the both-sides path 16, the sheet S which has been sent therein is set such that the surface thereof on which an image has not been formed faces the image forming section 11, and the sheet S is again sent to the sheet feed path 13. Then, in the same way as forming an image on one surf ace, the sheet S with the images formed on both surfaces is discharged to the discharge opening 2 via the discharge path 15.

The sheet finisher FS is connected to the discharge opening 2. The sheet S, on which the image has been formed, is sent from the discharge opening 2 into the sheet finisher FS. Then, at the sheet finisher FS, finishing processing by stapling is carried out. When the finishing processing is completed, the sheets S are accommodated on a loading or discharge tray 18.

The loading tray 18 is formed by a first loading portion 18*a* and a second loading portion 18*b*. The first loading portion 18*a* is located at substantially the same height as the discharge opening 2. The second loading portion 18*b* is located at an upstream side of the first loading portion 18*a* and at a lower position than the first loading portion 18*a*. The first loading portion 18*a* and the second loading portion 18*b* are connected via an inclined surface 18*c*.

Figure 2:
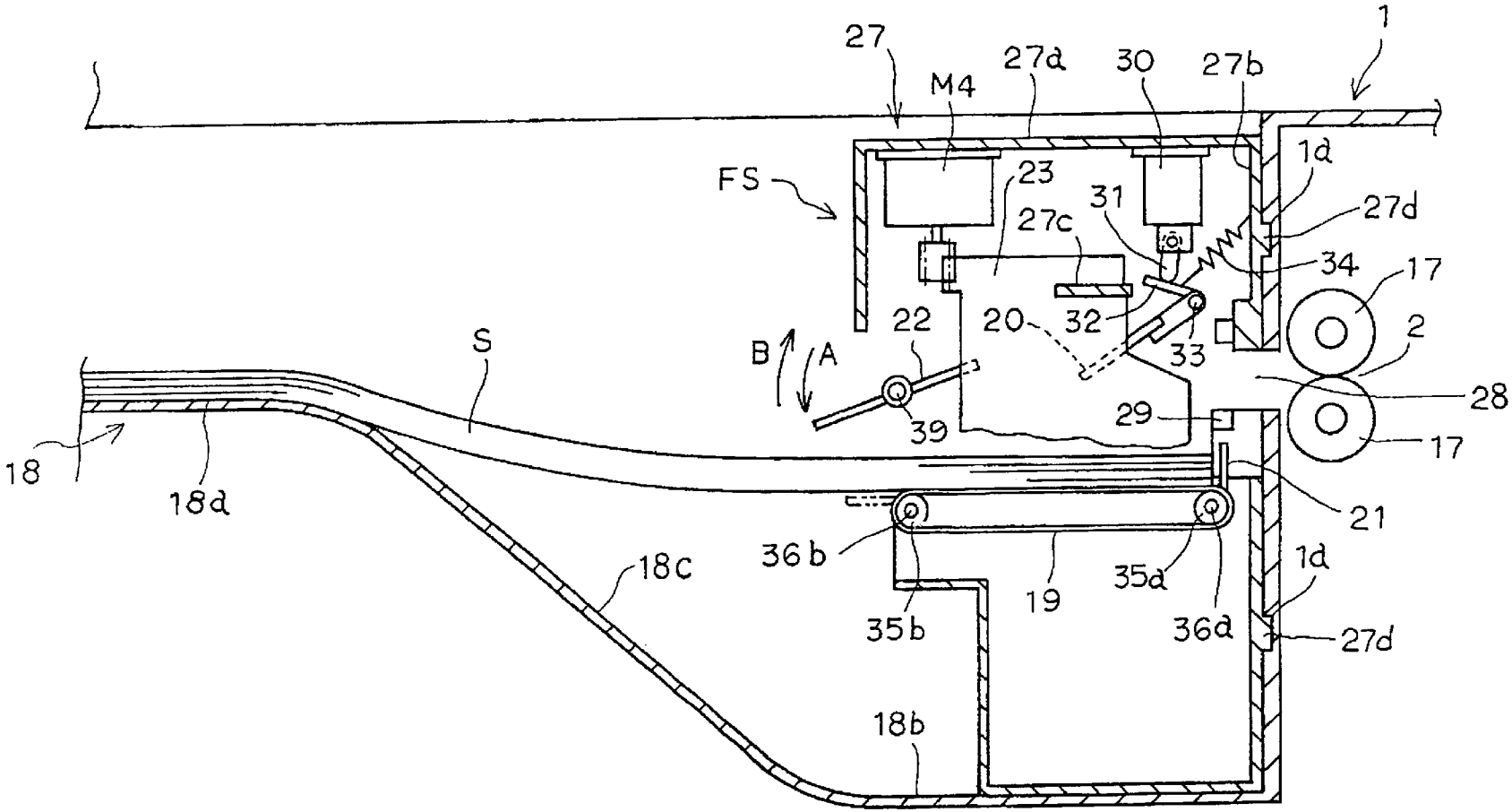
FIG. 2 is an enlarged view of main portions of the first embodiment.
Figure 3:
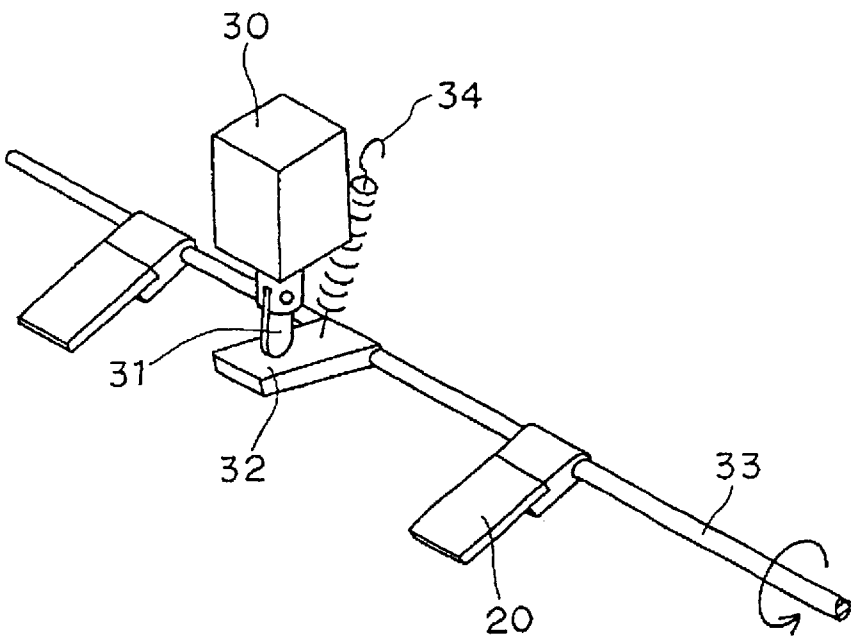
FIG. 3 is an enlarged view of the main portions of the first embodiment.
Figure 4:
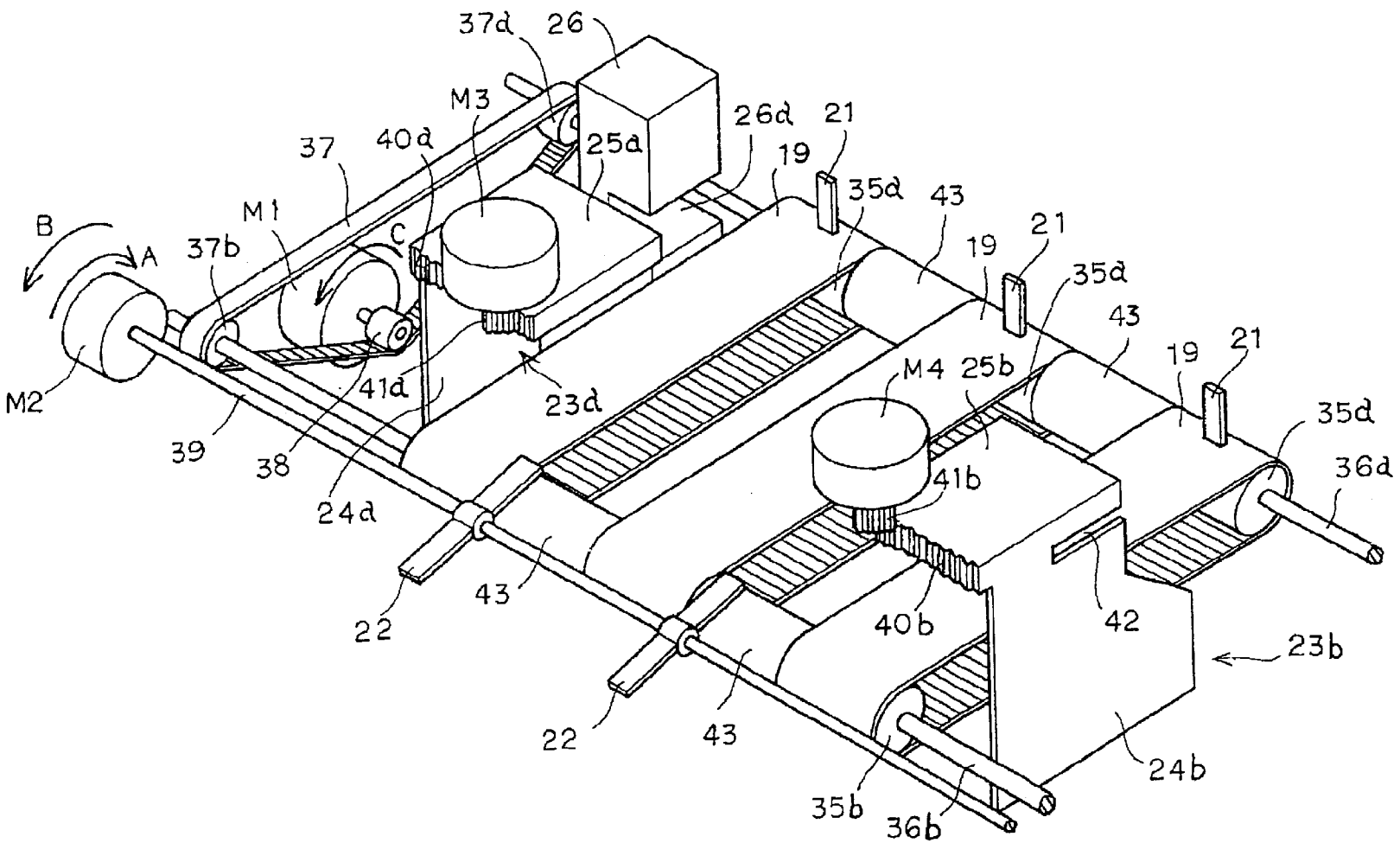
FIG. 4 is an enlarged view of an interior of a sheet finisher of the first embodiment.
Figure 5:
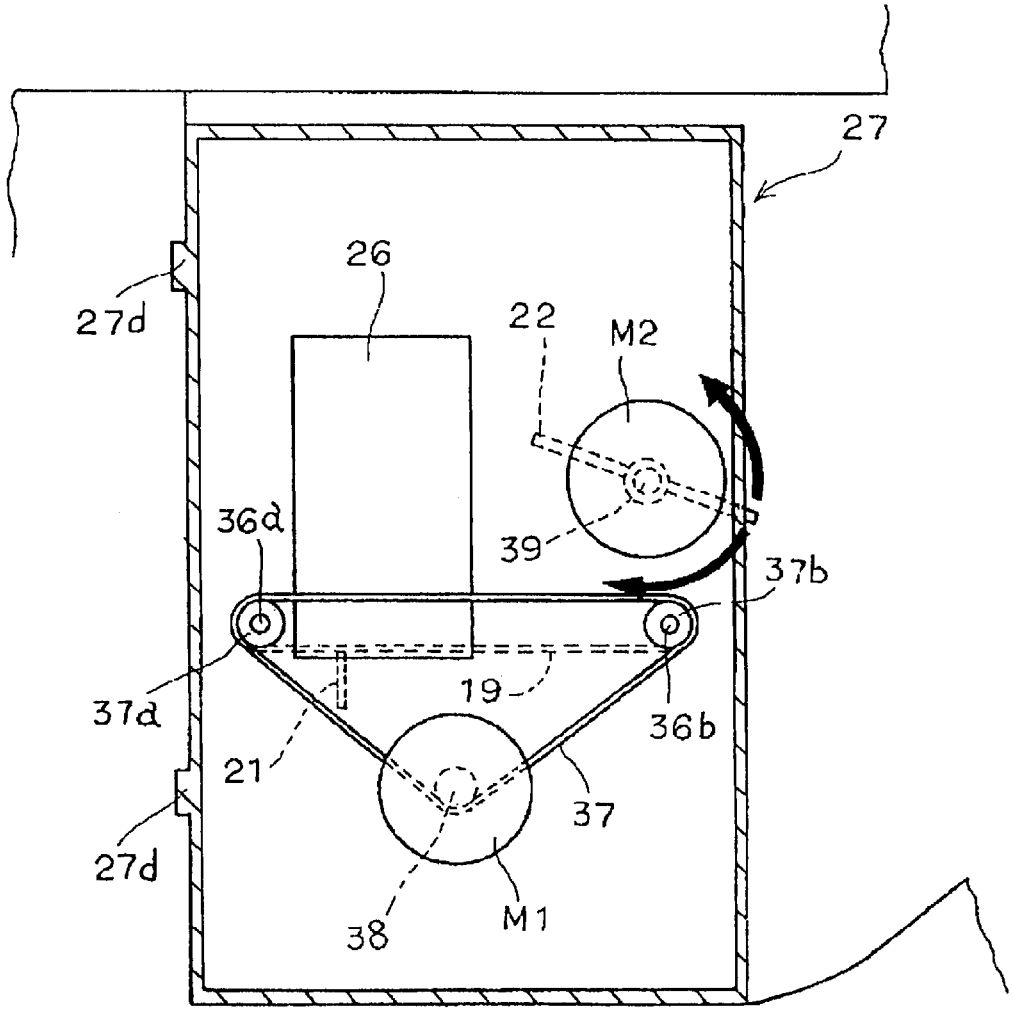
FIG. 5 is an enlarged sectional view of the sheet finisher of the first embodiment.

Next, details of the sheet finisher FS will be described with reference to FIGS. 2 through 4. FIG. 2 is an enlarged view of the sheet finisher FS of FIG. 1. FIGS. 3 and 4 are enlarged views of main portions of the interior of the sheet finisher. FIG. 5 is a view seen from the left side of FIGS. 3 and 4.

Here, in order to specify the orientation of the sheet S, the sides thereof parallel to the conveying direction are called the conveying direction, and the sides thereof orthogonal to the conveying direction are called the transverse direction. Further, a case in which a staple unit is used as the finishing processing unit of the sheets S, and transfer belts (transport device, or support and transport device) 19 are used as supporting members, is described.

The sheet finisher FS is provided with the transfer belts 19 which support the conveying direction trailing end portion of the sheet S; arms 20 which sweep the conveyed sheet S down onto the transfer belts 19; paddles 22 which make the trailing ends of the sheets S loaded on the transfer belts 19 abut against pusher claws 21 formed at the transfer belts 19 such that the trailing ends of the sheets S are aligned; adjusting plates 23*a*, 23*b* which align the transverse direction of the sheets S; a staple unit 26 for finishing processing to the aligned sheets S; and the cover 27 which covers these structural elements.

The cover 27 is formed by a ceiling surface 27*a* and side surfaces 27*b* which cover the four sides. A guide portion 27*c* is provided parallel to the ceiling surface 27*a*. The projections 27*d* are provided at the side surface 27*b* which contacts the image forming device 1. Mounting is carried out by the projections 27*d* being inserted into the mounting portions la of the image forming device 1.

By mounting the projections 27*d* of the cover 27 to the mounting portions 1*a* of the image forming device 1 in this way, an entrance 28, which is formed at the side surface 27*b* of the cover, and the discharge opening 2 of the image forming device 1 are positioned, and are connected by the rollers 17.

Further, a controller (not shown) is provided at the sheet finisher FS. First through fourth motors M1 through M4, which will be described later, are controlled by the controller.

In the above-described structural elements, the sheet S which has been discharged from the image forming device 1 is sent into the sheet finisher FS. Then, after plural sheets S have been stacked, the sheets S are subjected to finishing processing, and are loaded on the loading tray 18. Details thereof will be described hereinafter.

The sheet finisher FS is mounted to the image forming device 1 such that the entrance 28 of the sheet finisher FS and the discharge opening 2 of the image forming device 1 are connected. Thus, the sheet S, which is discharged from the discharge opening 2 of the image forming device 1, is sent into the entrance 28 of the sheet finisher FS by the rollers 17.

As described above, first, the first sheet S is conveyed to the sheet finisher 1. An entrance sensor 29 is provided at the entrance 28 of the sheet finisher FS, and confirms that the sheet S has been conveyed into the sheet finisher FS. Then, the sheet S is fed by the rollers 17 until the end thereof. When the entrance sensor 29 confirms the trailing end of the sheet S, the entrance sensor 29 sends a signal to a solenoid 30.

The solenoid 30 is provided at the ceiling 27*a* of the cover 27. As shown in FIG. 3, the solenoid 30 is connected to a rotating lever 32 via a solenoid shaft 31. One side of the rotating lever 32 is fixed to a shaft 33, and the arms 20 are fixed to the shaft 33. Namely, the rotating lever 32 and the arms 20 are connected via the shaft 33.

The solenoid shaft 31 and the rotating lever 32 are connected as described above, and the position of connection is near the side facing the side at which the shaft 31 is fixed. One end of a spring 34 is fixed to the connecting portion of the solenoid shaft 31 and the rotating lever 32, whereas the other end of the spring 34 is fixed to the side surface 27*b*, at the image forming device 1 side, of the cover 27.

In this structure, when a signal expressing that the trailing end of the sheet S has passed through the entrance is transmitted to the solenoid 30 from the entrance sensor 29, the solenoid 30 is turned on, and the solenoid shaft 31 extends. When the solenoid shaft 31 extends, the rotating lever 32 is pushed downwardly in FIG. 3 while extending the spring 34. When the rotating lever 32 is pushed downward, the shaft 33 connected thereto rotates in the direction of the arrow. When the shaft 33 rotates, together with this rotation, the arms 20 rotate in the direction of the arrow.

Due to the arms 20 rotating in this way, the trailing end portion of the sheet S which has been conveyed to the sheet finisher FS is swept and dropped downward in FIG. 3. The trailing end portion of the sheet S which has been swept and dropped downward is set on the transfer belts 19.

The transfer belts 19 are formed from a plurality of ring-shaped belts, and two rollers 35*a*, 35*b* are inserted at the inner sides of the transfer belts 19. Interval maintaining rollers 43, for maintaining the intervals between the transfer belts 19, are provided between the plural transfer belts 19.

The rollers 35*a*, 35*b* and the interval maintaining rollers 43 are supported by shafts 36*a*, 36*b* so as to be freely rotatable. These shafts 36*a*, 36*b* are fixed to the side surfaces 27*b* of the cover.

A drive belt 37 is provided at the two shafts 36*a*, 36*b*, separately from the transfer belts 19. The drive belt 37 is supported by rollers 37*a*, 37*b*, which are supported at the two shafts 36*a*, 36*b*, and by a motor shaft 38 of the first motor M1. The first motor M1 is fixed to the side surface 27*b* of the cover.

The transfer belts 19 have sizes which can support only the trailing end portions of the sheets S. The pressing claws 21 are formed so as to be directed toward the outer sides of the transfer belts 19. The pressing claws 21 stand vertically above the shaft 36*a* at the conveying direction trailing portion of the sheets S.

In this structure, due to the rotation of the first motor M1, the transfer belts 19 rotate, and the pressing claws 21 also rotate. Details thereof will be described later.

As described above, the sheet S which is conveyed from the entrance 2 is swept down by the arms 20 and placed on the transfer belts 19. In this way, by sweeping and dropping the sheet S downward, the trailing end of the sheet S can reliably be set on the transfer belts 19. As described above, because the transfer belts 19 have sizes which can support only the trailing end of the sheet S, if the arms 20 do not sweep the sheet S down, the sheet S which is conveyed by the rollers 17 may pass above the transfer belts 19.

In this way, only the trailing end of the sheet S is placed onto the transfer belts 19, and the leading end portion of the sheet S passes through the sheet finisher FS and is supported by the first loading portion 18*a* of the loading tray 18. Namely, the sheet S is supported so as to span between the transfer belts 19 and the first loading portion 18*a*.

When the arms 20 sweep the trailing end of the sheet S down onto the transfer belts 19, the extended spring 24 returns to its state before expansion. Due to the spring 34 returning to its state before expansion, the shaft 33 rotates in the direction opposite to the direction of the arrow in FIG. 3, and the arms 20 return to their initial positions.

When the sheet S is placed on the transfer belts 19, the paddles 22 shown in FIG. 2 rotate in the direction of arrow A, and push the sheet S back in the direction opposite to the conveying direction. The trailing end of the sheet S which has been pushed back abuts against the pushing claws 21 formed at the transfer belts 19, such that the trailing end of the sheet S is aligned.

Further, as shown in FIG. 4, the paddles 22 are connected to a shaft 39. Due to the rotation of the shaft 39, the paddles 22 rotate as well. The shaft 39 is connected to the second motor M2 which is provided at the side surface 27*b* of the cover.

When the trailing end of the first sheet S is aligned as described above, the second sheet S is conveyed from the image forming device 1. The conveyed second sheet S is placed on the first sheet S set on the transfer belts, and the trailing end of the second sheet S is aligned by the arms 20. Note that, in this case, the trailing ends of the sheets may be aligned by the pushing claws 21.

In this way, a predetermined number of sheets S are placed on the transfer belts 19. When a predetermined number of sheets S are loaded on the transfer belts 19 and the trailing ends of the sheets S are aligned, then, the adjusting plates 23*a*, 23*b* provided at the both transverse direction sides of the sheets S align the transverse direction of the sheet S.

Namely, the adjusting plates 23*a*, 23*b* are formed by adjusting portions 24*a*, 24*b*, which orthogonally abut against the transverse direction side surfaces of the sheets, and rack forming portions 25*a*, 25*b*, which are provided orthogonal to the adjusting portions 24*a*, 24*b* and at the top portions of the adjusting portions 24*a*, 24*b*. Racks 40*a*, 40*b* and pinions 41*a*, 41*b* which mesh therewith are formed at the side surfaces of the rack forming portions 25*a*, 25*b*. The pinion 41*a* is rotated by the third motor M3, and the pinion 41*b* is rotated by the fourth motor M4. The third and fourth motors M3, M4 are fixed to the ceiling surface 27*a* of the cover.

Sliding holes 42 are formed in the adjusting portions 24*a*, 24*b*. The guide 27*c* formed at the cover 27 is inserted into the sliding holes 42.

In this structure, after the paddles 22 have aligned the trailing ends of the sheets S, the fourth motor M4 rotates. When the fourth motor M4 rotates, the adjusting plate 23*b* makes the sheets S abut against the adjusting plate 23*a*, such that the transverse direction of the sheets S is aligned.

Figure 6A:
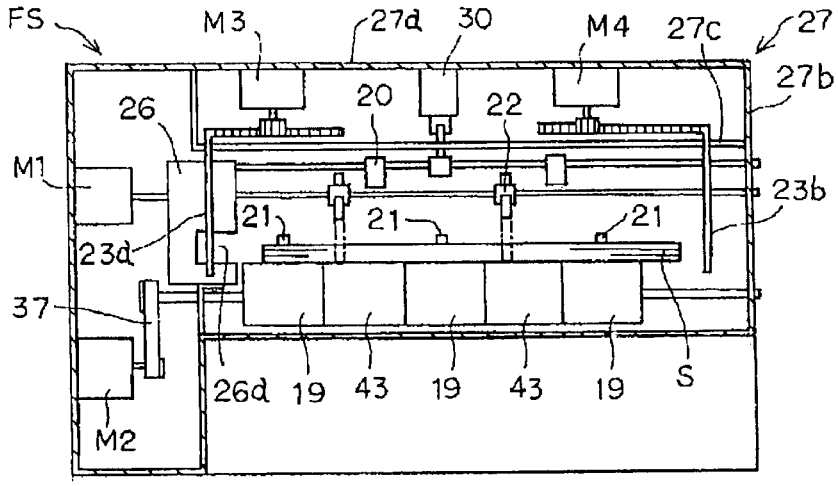
FIG. 6(*a*) is an explanatory view showing an initial position before sheets of the first embodiment are released.
Figure 6B:
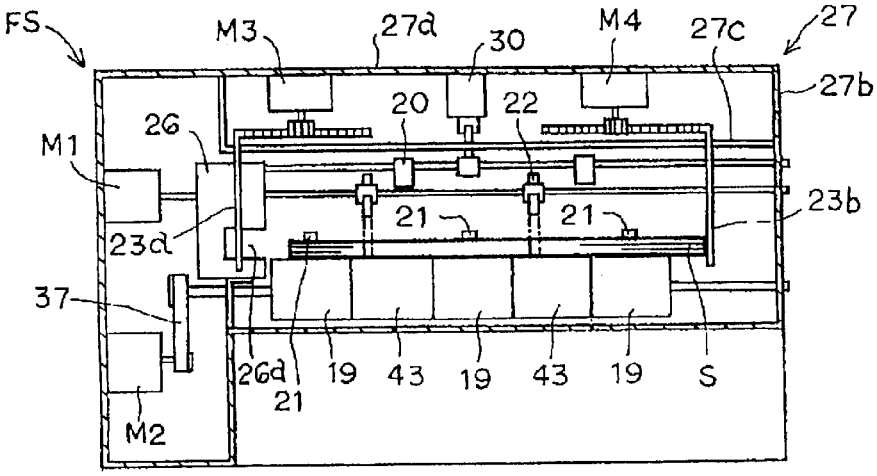
Figure 6C:
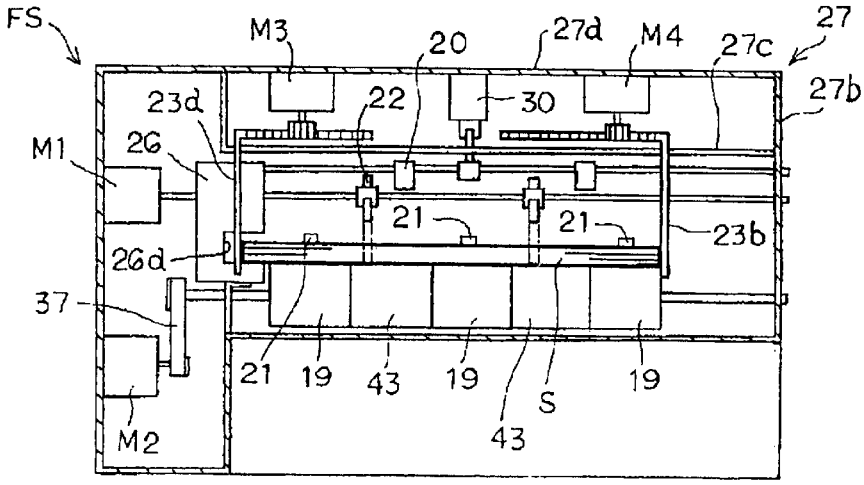

The movement of the adjusting plate 23*b* at this time is shown in FIGS. 6(*a*)–6(*c*). FIG. 6(*a*) shows an initial state before the adjusting plate 23*b* moves. When, from this state, the fourth motor M4 rotates and the pinion 41*b* rotates, the adjusting plate 23*b* moves toward the adjusting plate 23*a*, i.e. to the left in FIG. 6(*a*). When the adjusting plate 23*b* moves, the adjusting plate 23*b* abuts against the sheets S (FIG. 6(*b*)). The adjusting plate 23*b* which abuts against the sheets S moves further toward the left in the figure, and pushes the sheets S against the adjusting plate 23*a*. Due to the sheets S being pushed against the adjusting plate 23*a*, the transverse direction of the sheets S is aligned (FIG. 6(*c*)).

At this time, the transverse direction of the sheets S is aligned, and simultaneously, the trailing end portions thereof are inserted into a processing portion 26*a* of the staple unit 26 (FIG. 6(*c*)). The staple unit 26 is provided with staples and means for driving in the staples (both not shown). At the processing portion 26*a*, the staple is driven into the sheets S.

Accordingly, as described above, the sheets S, which are guided to the processing portion 26*a* by the adjusting plates 23*a*, 23*b*, are subjected to finishing processing by the staple being driven therein by the unillustrated staple driving-in means.

At this time, the position at which the staple is driven in is the trailing ends of the sheets S, and these trailing ends are supported by the transfer belts. Since the trailing ends, which are the portions to be stapled, are supported by the transfer belts in this way, stability at the time of stapling can be ensured more than if another portion of the sheets S were supported. Namely, the staple can be reliably driven into the sheets S without the sheets S shifting.

As described above, when the sheets S are subjected to finishing processing, the fourth motor M4 rotates in the direction opposite to the direction of rotation at the time of aligning the sheets S, and the adjusting plate 23*b* is moved toward the right. Simultaneously with the movement of the adjusting plate 23*b* toward the right, the third motor M3 is rotated in the same direction, and the adjusting plate 23*a* is also moved toward the right.

Due to the movements of the adjusting plates 23*a* and 23*b* toward the right in FIG. 6(*c*), the sheets S are also moved to the right. The sheets S, which have been subjected to the finishing processing, move away from the processing portion 26*a* of the stapling unit 26.

When the sheets S which have been subjected to the finishing processing are completely separated from the processing portion 26*a*, the first motor M1 shown in FIGS. 4 and 5 drives the motor shaft 38 to rotate in the direction of arrow C. When the motor shaft 38 rotates in the direction of arrow C, along with this rotation, the drive belt 37 also rotates in the direction of arrow C. Due to the rotation of the drive belt 37, the two shafts 36*a*, 36*b* which support the drive belt 37 rotate in the direction of arrow C.

When these shafts 36*a*, 36*b* rotate in the direction of arrow C, the rollers 35*a*, 35*b* supported by the shafts 36*a*, 36*b* also rotate. Due to the rotations of the roller 35*a* in the direction of arrow C and the roller 35*b* also rotating in the direction of arrow C in this way, the transfer belts 19 supported by the rollers 35*a*, 35*b* also rotate in the direction of arrow C.

When the transfer belts 19 rotate in the direction of arrow C, along with this rotation, the pushing claws 21 also rotate. As described previously, the sheets S which are set on the transfer belts 19 abut against the pushing claws 21. Accordingly, when the pushing claws 21 rotate, the sheets S are pushed by the pushing claws 21 and move.

Further, the transfer belts 19 rotate as described above, and the paddles 22 rotate in the direction of arrow B. Then, the sheets S are pushed out in the conveying direction. In this way, due to the rotation of the transfer belts 19 and the rotation of the paddles 22, the sheets S are loaded onto the loading tray 18.

Figure 7A:
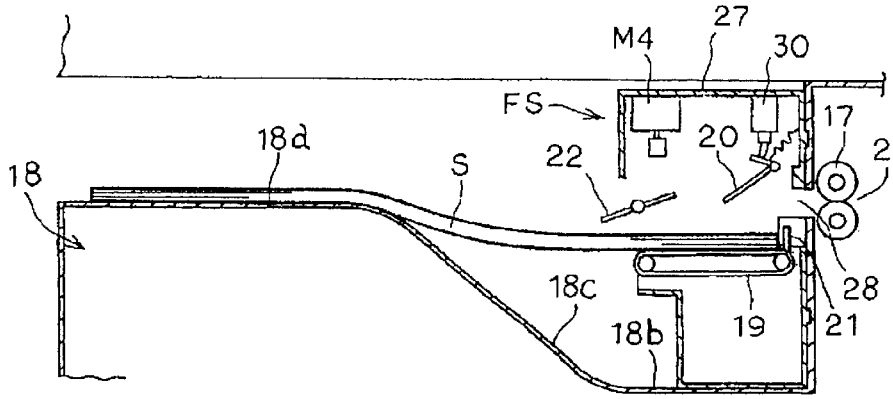
FIG. 7(*a*) is an explanatory view showing a state before the sheets S are aligned by an adjusting plate.
Figure 7B:
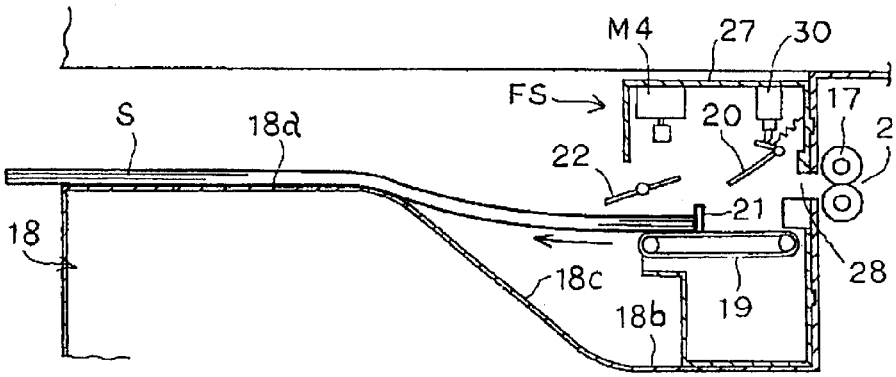
Figure 7C:
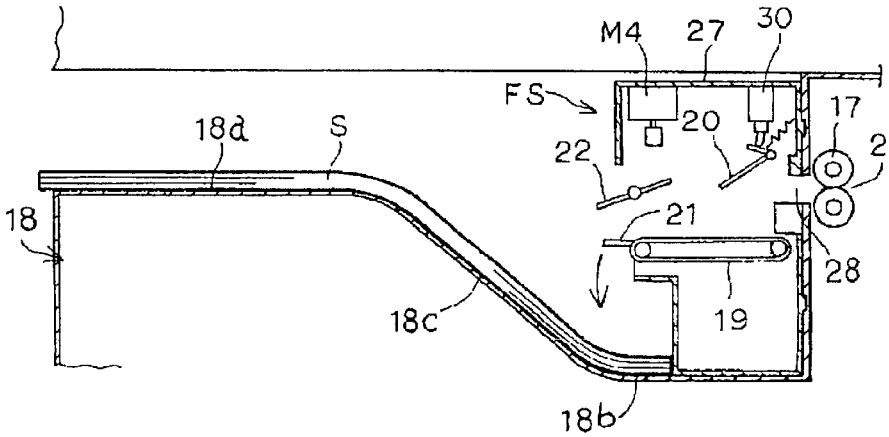

The states of the sheets S loaded on the loading tray 18 are shown in FIGS. 7(*a*)–7(*c*). Namely, as shown in FIG. 7(*a*), the trailing ends of the sheets S abut against a limiting plate and are set on the transfer belts 19. The pushing claws 21 are positioned at the inner side of the limiting plate. This state is the initial state.

In this initial state, the sheets S are placed on the transfer belts 19, and when the first motor M1 rotates, along with this rotation, the transfer belts 19 also rotate. As the transfer belts 19 rotate, the pushing claws 21 also rotate. At this time, as shown in FIG. 7(*b*), the sheets S move such that the trailing ends of the sheets S which abut against the pushing claws 21 are pushed out in the conveying direction.

Then, as shown in FIG. 7(*c*), when the trailing ends of the sheets S move to the shaft 36*b*, the sheets S drop down from the transfer belts 19 onto the loading tray 18. Due to dropping of the sheets S, the trailing ends of the sheets S are set on the second loading portion 18*b* of the loading tray 18, and the leading ends are set on the first loading portion 18*a*.

In accordance with the first embodiment, by rotating the transfer belts 19, the sheets S, for which the finishing processing has been completed, can be dropped down onto the transfer belts 19. Further, because the loading tray 18 is provided beneath the transfer belts 19, by merely rotating the transfer belts 19, the sheets S can be loaded onto the loading tray 18.

Accordingly, there is no need to provide the loading tray 18 at the outer side of the image forming device 1, and the floor area required for placement of the image forming device 1 can be reduced.

Further, the transfer belts 19 support only the trailing end portions of the sheets S which are conveyed from the image forming device 1, and the leading end portions of the sheets S can be supported by the loading tray 18. Thus, the size, in the conveying direction, of the transfer belts 19 can be reduced. By making the transfer belts 19 smaller, the space required for providing the transfer belts 19 can be reduced. Namely, the overall sheet finisher FS can be made more compact.

Accordingly, even if the compact sheet finisher FS is mounted to the image forming device, problems such as the height of the image forming device 1 becoming large do not arise.

As mentioned above, FIG. 5 is a view as seen from the left sides of FIGS. 3 and 4, and in FIG. 1, the back surface side of the sheet finisher FS is shown. Accordingly, in the state shown in FIG. 1, the operator stands at the front side, in the direction orthogonal to the surface of the drawing of FIG. 1, and removes the processed sheets in this direction.

In the present embodiment, the first motor M1 which drives the transfer belts 19 and the second motor M2 which drives the paddles 22 are disposed at the back surface side of the sheet finisher FS in FIG. 5, i.e., at the side away from the operator. In this way, the main finishing processing portions and driving sources are positioned at the side away from the operator, and the processed sheets can be easily removed from the front side of the device in FIG. 1. Accordingly, even when the sheet finisher is mounted, there is no need to change the direction in which the sheets are removed, and the operator does not experience a feeling of discomfort when using the device.

In the present first embodiment, the stapling unit is used as the sheet finishing unit. However, another finishing processing unit, such as a hole puncher or the like, may of course be used.

Further, the first motor M1 is used to rotate the transfer belts 19. However, another driving device, such as a solenoid or the like, may be used. In addition, although a solenoid is used to rotate the arms 20, another driving device may be used.

In the first embodiment, by rotating the transfer belts 19, the sheets S on the transfer belts 19 are moved and placed on the loading tray 18. However, the method for moving the sheets S is not limited to rotation of the transfer belts 19. Namely, a structure is possible in which, without rotating the transfer belts, another roller descends down from above the transfer belts such that the sheets S are nipped between the transfer belts and this roller. Then, by rotating this roller, the nipped sheets are conveyed onto the loading tray 18.

After the transverse direction of the sheets S has been aligned by the adjusting plates 23*a*, 23*b*, the adjusting plates 23*a*, 23*b* are both moved toward the right in FIG. 6 such that the sheets S are moved away from the processing portion 26*a* of the staple unit. However, the sheets S do not necessarily have to be separated from the processing portion 26*a*.

Namely, with the sheets S remaining inserted in the processing portion 26*a*, the transfer belts 19 may be rotated such that the sheets S are placed on the loading tray 18. In this case, there is no need to provide the third motor M3 at the adjusting plate 23*a*.

In the present embodiment, when the sheets S are aligned by the adjusting plates 23*a*, 23*b*, the sheets S are pushed from the one direction of the adjusting plate 23*b*, and the adjusting plate 23*a* does not move. However, the sheets S can be aligned by moving both adjusting plates 23*a* and 23*b*. Namely, when the sheets S are to be aligned, the adjusting plate 23*a* may be moved toward the adjusting plate 23*b* and the adjusting plate 23*b* may be moved toward the adjusting plate 23*a*, such that the adjusting plates are moved from both directions. After the sheets S have been aligned, while this aligned state is maintained, the adjusting plates 23*a*, 23*b* may simultaneously be moved toward the staple unit 26, and the sheets S are inserted into the processing portion 26*a*.

Further, in the first embodiment, the sheet finisher FS can be mounted to the discharge opening 2 side portion above the loading tray 18 of the image forming device 1. Namely, the loading portion 18*b* is the mounting portion of the sheet finisher FS.

If the sheet finisher FS is not mounted, the sheet discharged from the discharge opening 2 is supported by substantially the entire region of the loading tray 18. Further, the sheet is set such that substantially the entire surface thereof is supported on the loading tray.

However, in the present embodiment, the discharge opening 2 side portion of the loading tray 18 is used as the region for loading the sheet finisher FS. Accordingly, the region of the loading tray 18 which supports the sheet decreases by an amount corresponding to the loading of the sheet finisher FS, and the sheet projects slightly from the image forming device at the leading end side of the sheet in the conveying direction thereof. However, this projecting amount is set within a range which is allowable in practice. Thus, by mounting the sheet finisher, the tray for the finished sheets does not project greatly from the image forming device as in conventional devices.

Figure 8:
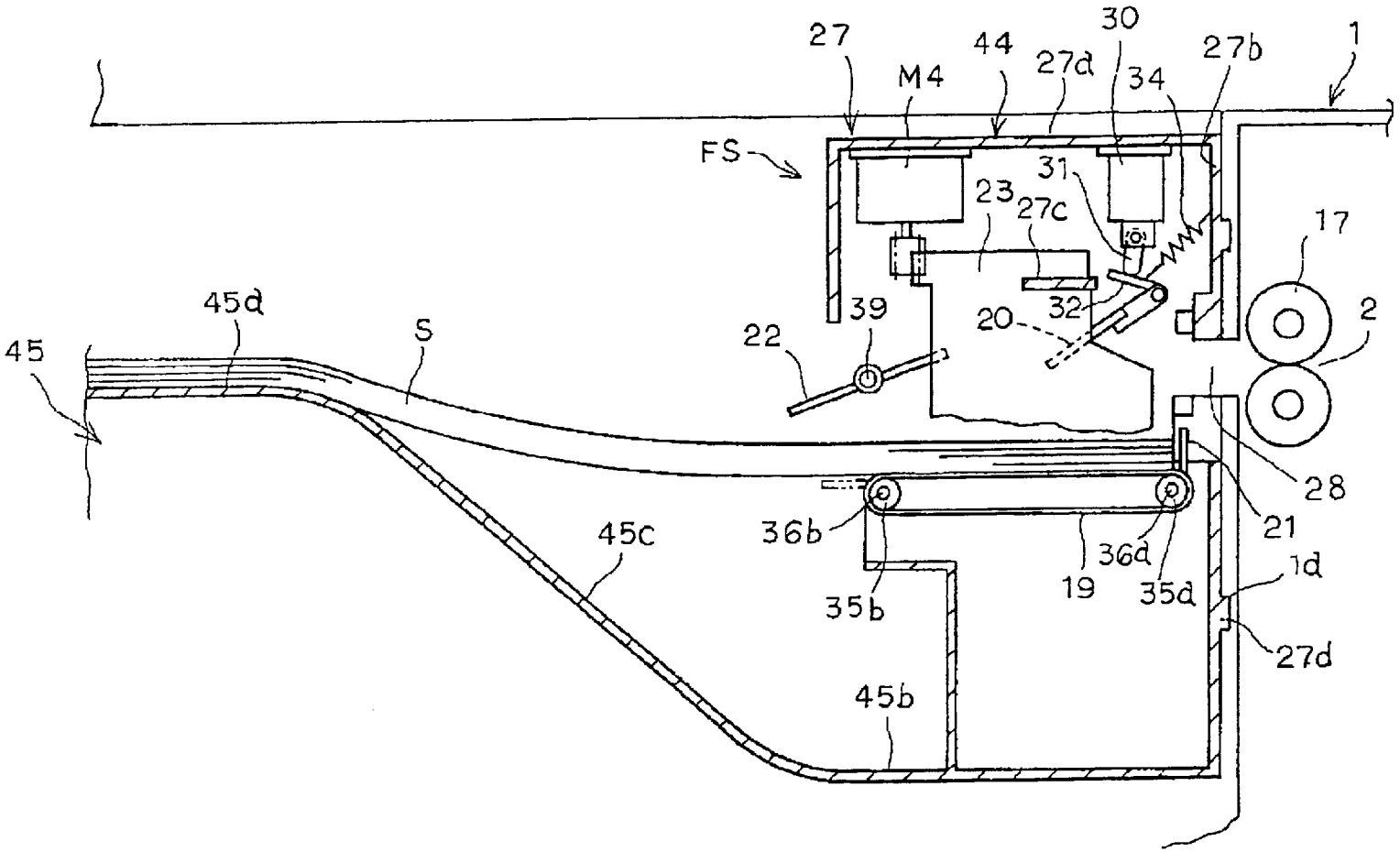
FIG. 8 is an explanatory view showing a second embodiment.

FIG. 8 illustrates a second embodiment whose feature is that the loading tray is formed integrally with the cover of the sheet finisher. Structures other than this feature are the same as those of the first embodiment. Structural elements which are the same as those of the first embodiment are denoted by the same reference numerals as in the first embodiment, and detailed description thereof is omitted.

In the present second embodiment, a loading tray portion 45 is provided at a cover 44 of the sheet finisher FS. The loading tray portion 45 has a first loading portion 45*a* and a second loading portion 45*b*. The first loading portion 45*a* is set at a position which is higher than the second loading portion 45*b*. The first loading portion 45*a* and the second loading portion 45*b* are connected via an inclined portion 45*c*. It is preferable that the position of the first loading portion 45*a* is located at substantially the same height as the discharge opening 2.

Further, the end portion of the second loading portion 45*b* which opposes the inclined portion 45*c* is connected to a side surface 44*a* of the cover 44. The second loading portion 45*b* is positioned beneath the transfer belts 19.

If there was no portion which was high at the loading tray such as the first loading portion 45*a*, it would be easy for the sheet S discharged from the discharge opening 2 to fall down from the transfer belts 19 due to the weight of the sheet S. In this case, because the sheet S would not be placed on the transfer belts 19, the finishing processing by the stapling unit 26 would not be carried out. Further, even if the sheet S was placed on the transfer belts 19, since the conveying direction leading end portion of the sheet S is heavy, the sheet S could not be aligned well.

The methods of conveying, aligning and finishing the sheets S are the same as in the first embodiment.

In the present second embodiment, the first loading portion 45*a* and the second loading portion 45*b* are provided at the sheet finisher FS. Thus, satisfactory finishing processing of the sheets S is possible even at an image forming device which does not have a first loading portion.

Further, in accordance with the present second embodiment, without providing a separate loading tray, the compact sheet finisher FS can be mounted to the image forming device 1 whose loading tray is not inclined. Thus, the entire image forming device can be made more compact.

Figure 9:
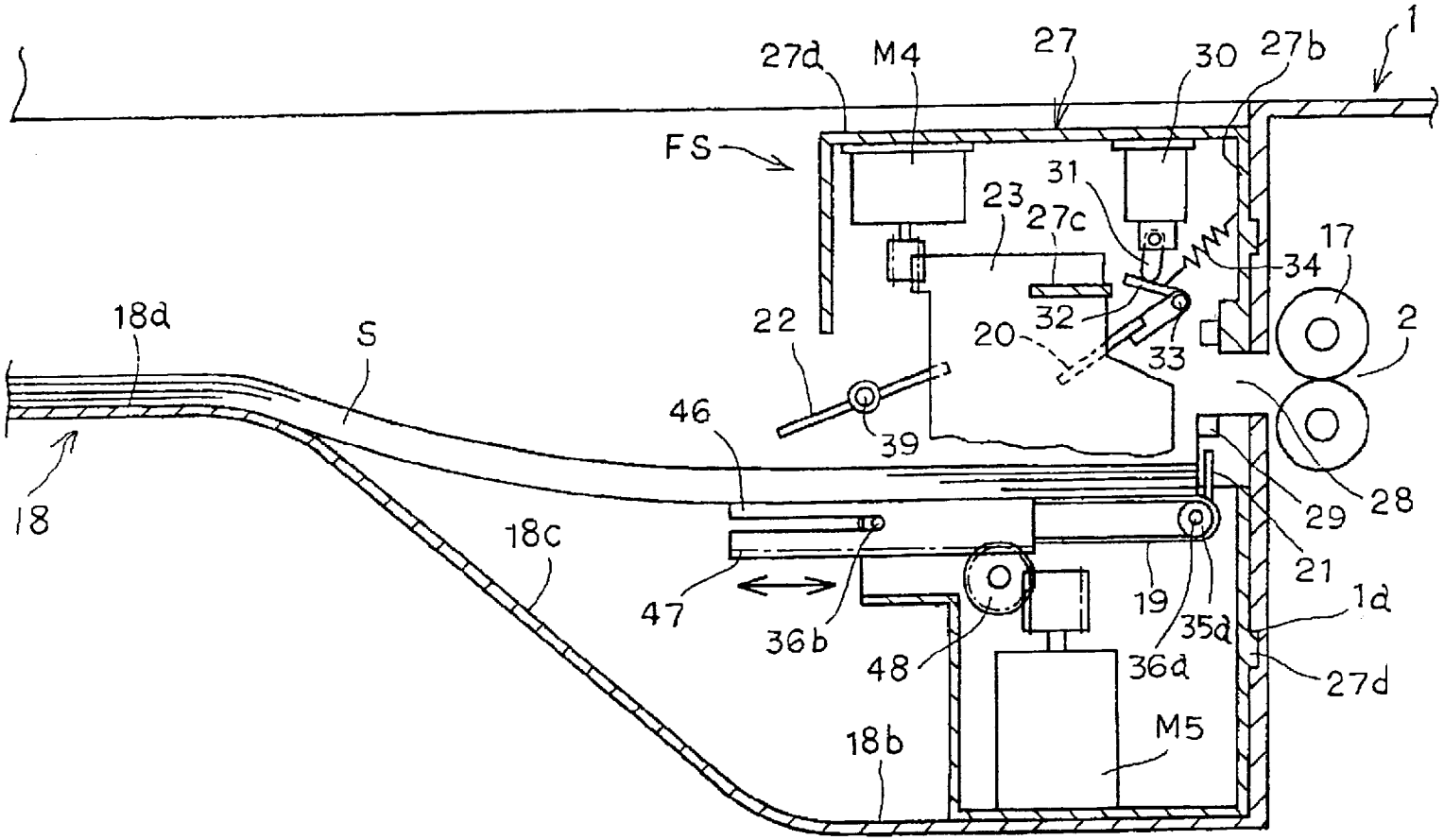
FIG. 9 is an explanatory view showing a third embodiment.
Figure 10:
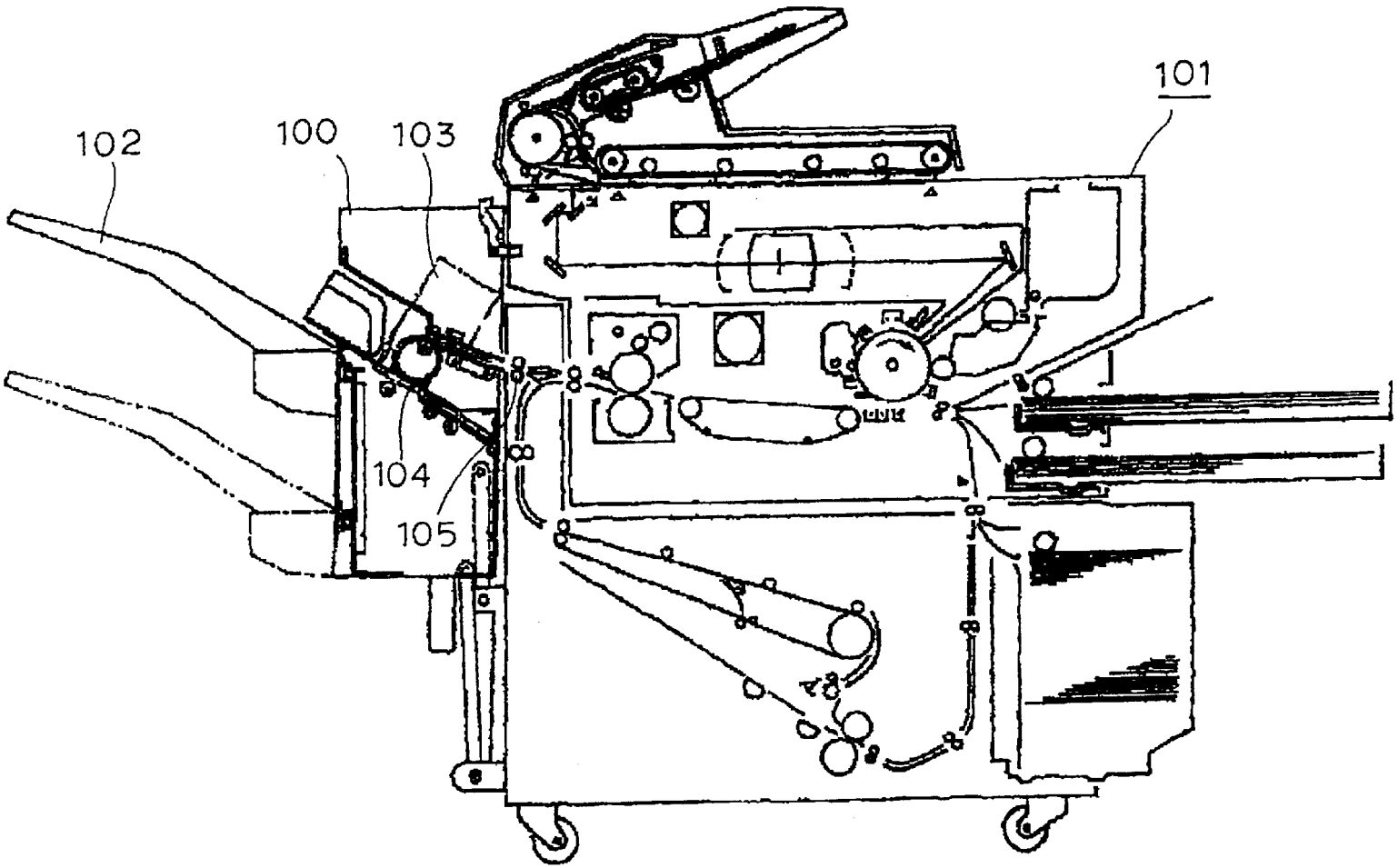
Fig. 10 Prior Art
FIG. 10 is a drawing showing a conventional example.
Figure 11:
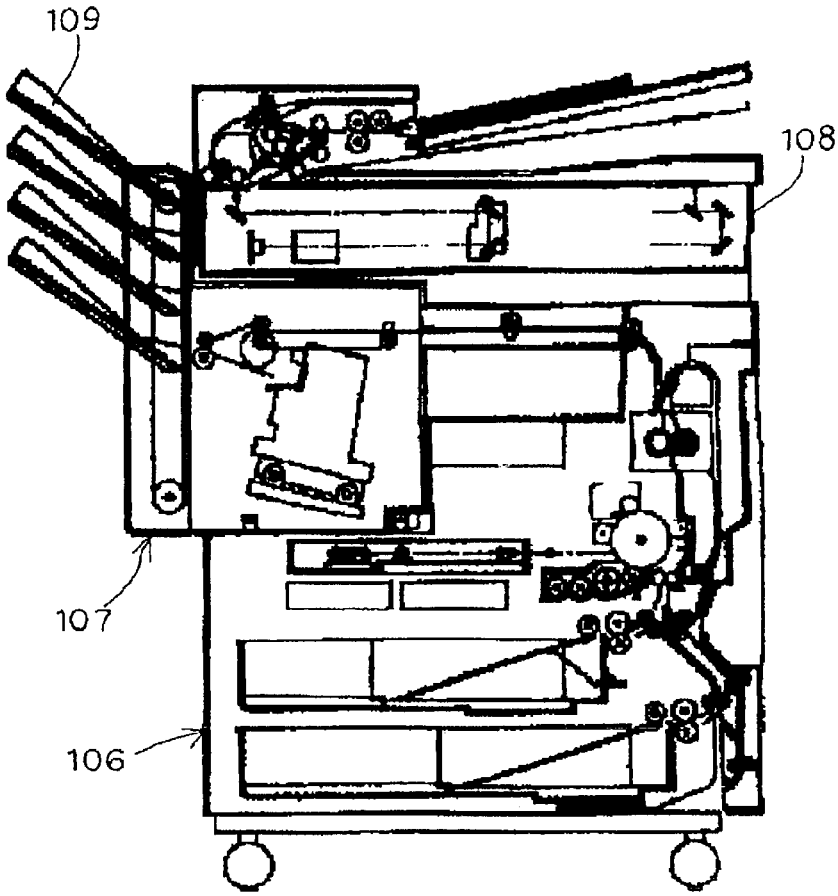
Fig. 11 Prior Art
FIG. 11 is a drawing showing a conventional example.
Figure 12:
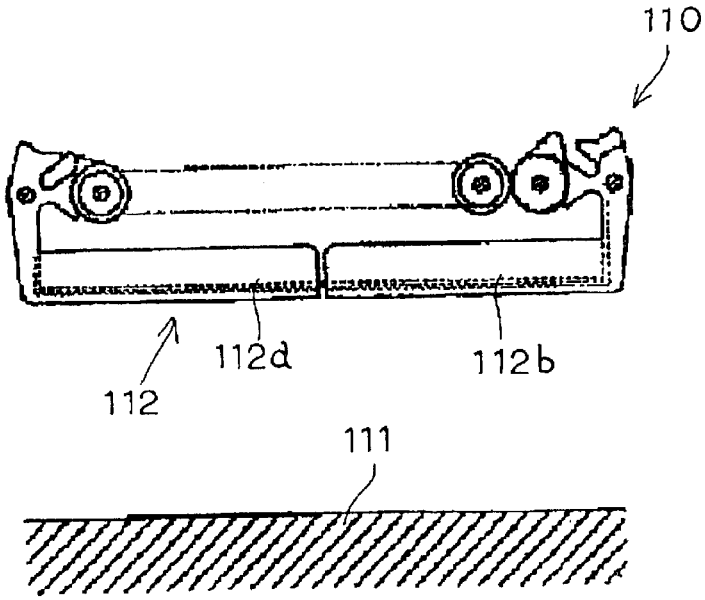
Fig. 12 Prior Art
FIG. 12 is a drawing showing a conventional example.

FIG. 9 illustrates a third embodiment whose feature is that an assisting plate, which can extend and contract in the directions of the arrows, is provided at the sheet finisher. Structures other than this feature are denoted by the same reference numerals as in the first embodiment, and detailed description thereof is omitted.

In the present third embodiment, an assisting plate 46 is provided beneath the transfer belts 19 of the sheet finisher FS. In the initial state, as shown in FIG. 9, the assisting plate 46 extends from the transfer belts 19 in the conveying direction. A rack 47 is formed at the bottom surface of the assisting plate 46. A pinion 48 which meshes with the rack 47, and a fifth motor M5 which drives the pinion 48 are disposed within the cover 27, and are provided beneath the transfer belts 19.

When the fifth motor M5 rotates, the assisting plate 46, which is extended from below the transfer belts 19, contracts and is accommodated beneath the transfer belts 19. Further, when the fifth motor is rotated in the direction opposite to that described above, the assisting plate 46, which is accommodated beneath the transfer belts 19, again extends and returns to its initial state.

In the third embodiment having this structure, when the sheet S is conveyed from the image forming device 1, the trailing end of the conveyed sheet S is placed on the transfer belts 19 and the leading end thereof is placed onto the first loading portion. At this time, the assisting plate 46 is in its initial state, i.e. in the state in which the assisting plate 46 is extended and projects from beneath the transfer belts 19.

In this way, by extending the assisting plate 46, the region of the sheet S between the trailing end of the sheet S which is supported at the transfer belts 19 and the leading end which is supported at the first loading portion 18*a* of the loading tray 18, can be supported at the assisting plate 46. Thus, the sheet S contacts a larger surface area, and the entire sheet S can be supported stably.

As described above, when the sheets S are placed on the transfer belts 19, the assisting plate 46, and the first loading portion 18*a*, in the same way as in the first embodiment, the transverse direction of the sheets S is aligned by the adjusting plates 23*a*, 23*b*.

Then, after the sheets S are aligned by the adjusting plates 23*a*, 23*b*, the finishing processing is carried out by the staple unit 26. When the finishing Processing of the sheets S has been completed, the fifth motor M5 is rotated forward. When the fifth motor is rotated, the pinion 48 rotates. Since the rack 47 meshes with the pinion 48, the assisting plate 46 moves toward the right in the figure. Namely, the assisting plate 46, which extends from below the transfer belts 19, contracts, and is accommodated beneath the transfer belts 19.

When the assisting plate 46 is accommodated, the first motor M1 is driven, and the transfer belts 19 are rotated. When the transfer belts 19 rotate, the pressing claws 21 formed at the transfer belts 19 move so as to push the trailing ends of the sheets S out to the loading tray 18, and the sheets S are loaded on the loading tray 18.

In this way, when the sheets S, for which the finishing processing has been completed, are loaded onto the loading tray 18, the assisting plate 46 is contracted. Thus, the assisting plate 46 does not get in the way. Further, the sheets S can be stably loaded onto the loading tray 18.

As described above, in accordance with the present invention, the sheet finisher unit is disposed above the loading tray of the top portion of the image forming device main body, and the sheet finisher unit includes the supporting means for supporting the conveying direction downstream side of the sheet which is discharged; and the finishing processing means, disposed at one side of the supporting means, for carrying out the finishing processing on the sheet supported on the supporting means. The transfer means transfers and discharges a sheet, which has been processed at the finishing processing means, to the loading tray disposed at the conveying direction downstream side. Thus, the loading tray at the top surface of the image forming device can be used as the loading portion of the sheet finisher and as the stacking portion of the sheets which have been subjected to the finishing processing. When the sheet finisher is mounted, there is no need to provide a new stacking tray for the processing device for the sheets which have been subjected to finishing processing.

Further, the transfer means is formed from the transfer belts and rollers for rotating the transfer belts, and the transfer means is provided with the pressing claws at the transfer belts. The pressing claws 21 limit the trailing end position of the sheet and push the sheet onto the loading tray. Thus, by merely rotating the transfer belts, the sheet can be reliably conveyed to the loading tray.

Moreover, the loading tray is formed from the first loading portion which supports the conveying direction leading end side of the sheet supported at the supporting means, and the second loading portion which supports the conveying direction trailing end portion of the sheet which is transferred and discharged by the transfer means. Thus, by merely moving the sheets, from the state in which the sheets are supported by the supporting member, in a direction in which the sheets fall down, the sheets can reliably be loaded onto the loading tray.

Further, the supporting means includes the assisting plate which is extendible and contractible and which can support the sheet, and the assisting plate has the extended position at which the assisting plate is extended to the sheet conveying direction downstream side, and the retracted position at which the assisting plate is retracted to the sheet conveying direction upstream side of the extended position. Thus, at the time the sheet is supported, the sheet can be supported more stably. Further, at the time when the sheet is loaded onto the loading tray, the assisting plate is retracted, and thus does not hinder the dropping down of the sheet.

Moreover, in accordance with the present invention, the image forming device further comprises the image reader which reads images and which is provided above the discharge portion and the loading tray at the top portion of the image forming device main body, wherein the sheet finisher which is formed by the unit is provided adjacent to the discharge opening and between the image reader and the loading tray. Thus, the sheet finisher and the sheet finisher tray need not be formed at the outer side of the image forming device. Accordingly, the area for placing the image forming device can be made small.

Still further, the present invention provides the image forming device comprising: the discharge opening which discharges the sheet and is provided at the upper portion of the image forming device main body; and the loading tray onto which the sheet discharged from the discharge opening is loaded, wherein the loading tray includes: at the discharge opening side, the unit mounting portion to which the finishing processing unit, which carries out finishing processing of the discharged sheet, is mounted; and at the downstream side of the loading portion, the sheet loading portion on which the sheet, which has been subjected to finishing processing, is loaded. Accordingly, it suffices to merely mount the sheet finisher to the loading tray. Further, even in a case in which the sheet finisher is loaded at the image forming device, the area for placing the image forming device is not large.

Further, the present invention provides the image forming device including the discharge portion having the discharge opening which discharges the sheet from one end side of the top surface of the image forming device main body, in a direction traversing the device main body. The sheet finishing processing unit is formed by the supporting means for supporting the conveying direction downstream side of the sheet discharged from the discharge opening; the finishing processing means disposed adjacent to one side of the supporting means, for carrying out finishing processing on the sheet supported on the supporting means; the transfer means for transferring the sheet, which is processed at the finishing processing means, to the conveying direction downstream side; and the loading tray on which the sheet, which is transferred by the transfer means, is loaded. This sheet finishing processing unit is disposed at the position corresponding to the discharge opening of the top surface of the main body.

Accordingly, the sheet finisher can easily be mounted even to the existing image forming devices having a loading tray not suitable for the loading of sheets which have been subjected to finishing processing. Further, the image forming device of the present invention can be used as the image forming device to which the sheet finisher is mounted, without enlarging the area for placing the image forming device. Namely, even if the image forming device does not have a loading tray, the sheet finisher may merely be mounted to the image forming device, and there is no need to mount a special loading tray.

Moreover, the supporting means is disposed in a substantially horizontal state, and the loading tray is formed from the first loading portion which supports a conveying direction leading end side of the sheet supported at the supporting means, and the second loading portion which supports the conveying direction trailing end portion of the sheet which is transferred by the transfer means. Thus, the image forming device can be made to be shorter, in the heightwise direction, than structures in which the supporting means is disposed at an angle above. Further, by merely moving the sheets, from the state in which they are supported by the supporting means, in the direction in which the sheets fall down, the sheets can be reliably loaded on the loading tray.

The present invention further provides the image forming device including the loading tray which is provided at the top portion of the image forming device main body and on which the discharged sheet is loaded, and the image reader which is provided above the loading tray and which reads an image of an original. At the image forming device, the sheet discharged onto the loading tray is removed from the front side intersecting the sheet discharging direction. The image forming device comprises the sheet finisher between the loading tray and the image reader, and the sheet finisher includes: the supporting means for supporting the conveying direction downstream side of the discharged sheet; the finishing processing means, disposed at one side of the supporting means, for carrying out finishing processing on the sheet supported on the supporting means; the transfer means for transferring the sheet, which is processed at the finishing processing means, to the conveying direction downstream side; and the driving means for driving the transfer means, wherein at least the finishing processing means and the driving means are disposed at the opposite side of the sheet removing direction.

Accordingly, the finishing processing unit and the driving means of the finisher are disposed at the opposite side from the sheet removal direction. Thus, even when the sheet finisher is mounted to the existing image forming device, the sheets can be removed without greatly changing the way of removing the sheets from a case in which the sheet finisher is not mounted.

While the invention has been explained with reference to the specific embodiments of the invention, the explanation is illustrative, and the invention is limited only by the appended claims.

What is claimed is:

1. An image forming device comprising:

an image forming device main body having a discharge portion with a discharge opening disposed at one side of an upper portion thereof for discharging a sheet with an image formed thereon onto the main body in a direction crossing the main body, and a top surface, a discharge tray provided at the top surface of the main body for receiving the sheet discharged from the discharge opening, said discharge tray having upstream and downstream sides relative to a sheet discharging direction, said downstream side being located higher than the upstream side, and a sheet finisher unit disposed above the upstream side of the discharge tray, said sheet finisher unit including support and transport means for supporting a conveying direction downstream side of the sheet discharged from the discharge opening, and finishing processing means disposed at one side of the support and transport means for carrying out a finishing processing on the sheet supported on the support and transport means, said support and transport means transferring the sheet, which has been processed at the finishing processing means and located on the support and transport means, to the downstream side of the discharge tray.

2. An image forming device according to claim 1, wherein said support and transport means is formed of at least one transfer belt for supporting the sheet having a pressing claw for limiting a trailing end position of the sheet and pushing the sheet onto the discharge tray, and rollers engaging the at least one transfer belt for rotating the same.

3. An image forming device according to claim 1, wherein the discharge tray is formed of a first loading portion for supporting a conveying direction leading end side of the sheet supported at the support and transport means, and a second loading portion disposed lower than the support and transport means, said second loading portion supporting the conveying direction downstream side of the sheet transferred and discharged by the support and transport means.

4. An image forming device according to claim 1, wherein said support and transport means includes an assisting plate which is extendible and contractible and can support the sheet, said assisting plate having an extended position at which the assisting plate is extended to a sheet conveying direction downstream side, and a retracted position at which the assisting plate is retracted to a sheet conveying direction upstream side.

5. An image forming device according to claim 1, further comprising an image reader for reading images provided above the discharge portion and the discharge tray at the top surface of the image forming device main body, said sheet finisher formed as the unit being provided adjacent to the discharge opening and between the image reader and the discharge tray.

6. An image forming device according to claim 1, wherein said sheet finisher unit further includes a first adjusting plate disposed along the support and transport means for adjusting a location of the sheet in a direction perpendicular to a transfer direction of the support and transport means, said first adjusting plate being located at a side opposite to the finishing unit.

7. An image forming device according to claim 6, wherein said sheet finisher unit further includes a second adjusting plate disposed at a side opposite to the first adjusting plate.

8. An image forming device, comprising:

an image forming device main body having a discharge portion with a discharge opening provided at one side of an upper portion thereof for discharging a sheet with an image formed thereon onto the main body in a direction crossing the main body, and a sheet processing unit including support and transport means for supporting a conveying direction downstream side of the sheet discharged from the discharge opening, said support and transport means constituting a transfer device for transferring the sheet to a conveying direction downstream side, finishing processing means disposed adjacent to one side of the support and transport means for carrying out finishing processing on the sheet supported on the support and transport means, said sheet processed at the finishing processing means being transferred by the support and transport means constituting the transfer device to a conveying direction downstream side, and a discharge tray having a first loading portion for supporting a downstream side of the sheet supported by the support and transport means and a second loading portion for supporting an upstream side of the sheet, said first loading portion being located at a position lower than the second loading portion and the transfer device, said sheet processing unit being disposed on the main body at a position corresponding to the discharge opening of the main body.

9. An image forming device according to claim 8, wherein said support and transport means is disposed in a substantially horizontal state.

10. An image forming device according to claim 8, wherein said support and transport means operating as the transfer device is formed of at least one transfer belt for supporting the sheet having a pressing claw for limiting a trailing end position of the sheet and pushing the sheet onto the discharge tray, and rollers engaging the at least one transfer belt for rotating the same.

11. An image forming device, comprising:

an image forming device main body for forming an image on a sheet and having an upper surface, a back side and a front side, a discharge tray for mounting the sheet discharged from the main body, said discharge tray being located above the upper surface between the back side and the front side so that the sheet discharged on the discharge tray is taken out through the front side of the main body at a portion crossing a sheet discharge direction, an image reader situated above the discharge tray for reading an image of an original, and a sheet finisher situated between the discharge tray and the image reader vertically separated from each other, and including supporting means for supporting a conveying direction downstream side of the sheet; finishing processing means disposed at one side of the supporting means for carrying out finishing processing on the sheet supported on the supporting means; a transport device for transporting the sheet processed at the finishing processing means to a conveying direction downstream side; and driving means for driving the transfer means, the finishing processing means and the driving means being disposed at the rear side opposite to the front side for removing the sheet.

12. An image forming device according to claim 1, wherein said transport device constitutes the supporting means.

13. An image forming device according to claim 12, wherein said supporting means operating as the transport device is formed of at least one transfer belt having a pressing claw for limiting a trailing end position of the sheet and pushing the sheet onto the loading tray, and rollers engaging the at least one transfer belt for rotating the same.

* * * * *